United States Patent [19]

Haentjens

[11] Patent Number: 4,761,235

[45] Date of Patent: Aug. 2, 1988

[54] WASTE COLLECTION DEVICE FOR GARBAGE GRINDER

[75] Inventor: Kathleen S. Haentjens, Hazleton, Pa.

[73] Assignee: Hazleton Stainless Casting Company, Hazleton, Pa.

[21] Appl. No.: 2,451

[22] Filed: Jan. 12, 1987

[51] Int. Cl.[4] ..... B01D 21/00

[52] U.S. Cl. ..... 210/532.1; 210/539; 210/540; 4/629; 4/DIG. 4

[58] Field of Search ..... 210/532.1, 532.2, 533, 210/521, 539, 248, 800, 801, 802, 173, 233, 240, 120, 436, 538, 472, 172, 237, 90, 153; 4/317-321, 629, DIG. 4, DIG. 19

[56] References Cited

U.S. PATENT DOCUMENTS

| | | | |
|---|---|---|---|
| 1,164,527 | 12/1915 | Kelley | 210/311 |
| 1,856,099 | 5/1932 | Hertsch | 210/538 |
| 1,910,186 | 5/1933 | Sisk | 210/237 |
| 2,338,971 | 4/1942 | Ross | 210/532.1 |
| 2,624,463 | 1/1953 | Freese | 210/532.1 |
| 4,020,860 | 5/1977 | Fournier et al. | 137/69 |
| 4,034,422 | 7/1977 | Färber et al. | 4/DIG. 4 |
| 4,310,933 | 1/1982 | Stratman | 4/DIG. 4 |
| 4,440,639 | 4/1984 | Galuska | 210/120 |

*Primary Examiner*—Richard V. Fisher
*Assistant Examiner*—Coreen Y. Lee
*Attorney, Agent, or Firm*—Hill, Van Santen, Steadman & Simpson

[57] ABSTRACT

A waste collection device for accumulating solid waste downstream of a kitchen garbage grinder includes a separator for settling solid material from waste water and a removable waste accumulating container into which household garbage is collected. The waste accumulating container is removable and a cap, including a carrying handle, is fastenable over the opening for carrying to and emptying onto a compost heap. A pressure release valve is provided in the waste accumulating container to prevent damage from the build-up of gases.

13 Claims, 1 Drawing Sheet

FIG. 3
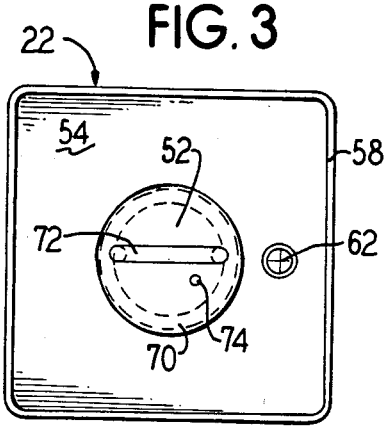
FIG. 2
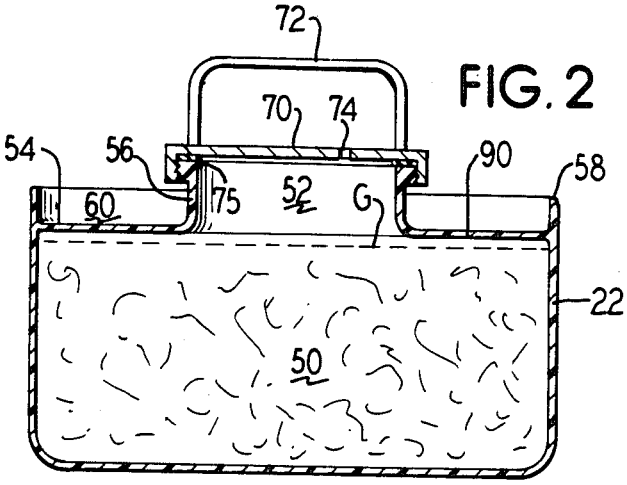
FIG. 6
FIG. 5
FIG. 1
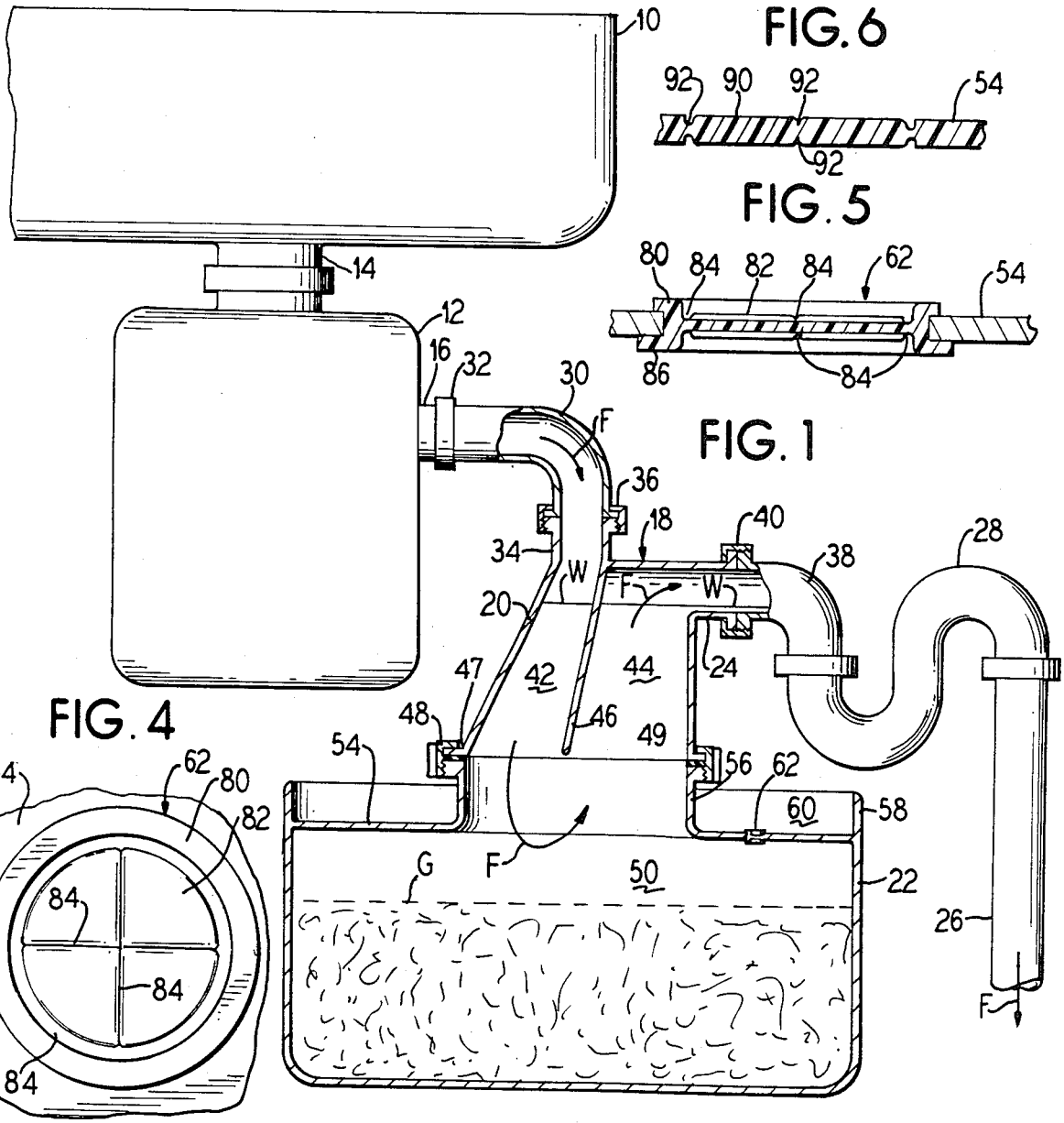
FIG. 4
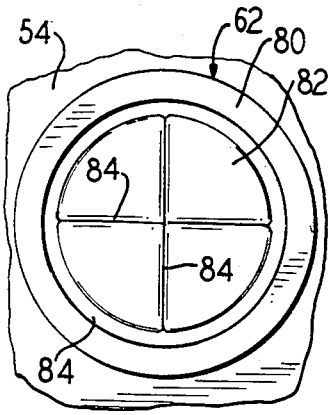

WASTE COLLECTION DEVICE FOR GARBAGE GRINDER

BACKGROUND OF THE INVENTION

The present invention relates generally to a waste separating device for use in a waste flow, such as from a garbage grinder.

Gardeners and others interested in organic gardening frequently maintain compost heaps into which vegetable waste is placed for decomposition to create an organic fertilizer, or compost. The use of the decomposed vegetable matter provides a rich growing medium for both edible and ornamental garden plants.

It is known that household garbage provides a rich source of compost material that is frequently used in compost heaps. Instead of being accumulated for use in a compost heap, however, household garbage is generally fed into a garbage grinder, or so called garbage disposal, for flushing into a sewage system.

SUMMARY OF THE PRESENT INVENTION

An object of the present invention is to provide a device for accumulating household garbage that has been fed through a garbage grinder, or so-called garbage disposal, so that it can be used in a compost heap.

Another object of the present invention is to provide a means for separating and accumulating solid waste material from a liquid flow in a waste water transmittal system.

These and other objects of the present invention are achieved in a waste collection device connectable between a household garbage grinder and a sewage system, and including a solid waste separator and a waste accumulator. The solid waste separator is connected in a waste water transmitted system, such as at an outlet of a kitchen garbage grinder. The separator, by reducing the flow velocity of the waste water and by preventing flush-through, causes solid waste material to settle from the waste water. The separator has two outlets, a first connected to the waste accumulator into which the solid material settles, and a second through which excess waste water flows to a sewage transmittal system.

The waste accumulator is in the form of a container which is removably fastenable to the first outlet of the separator. Solid material settles into the container and remain there until the container is removed for emptying at a compost heap. The present waste collection device is preferably mounted in a cabinet below a kitchen sink and is, thus, out of sight, yet easily accesible.

In one development, the waste accumulation container includes a pressure relief valve to release accumulated gases, such as caused by the breakdown of the accumulated organic material, and thereby prevent an explosion of the waste container. A further development of the present invention is embodied in a raised lip extending about the top surface of the accumulation container to form a catch basin into which waste water drains during removal of the accumulation container from the separator.

Thus, household garbage and other organic material can be safely and efficiently collected downstream of a garbage grinder for use in a compost heap so that the rich organic material contained therein can be used to enrich the composting material.

BRIEF DESCRIPTION OF THE DRAWINGS

FIG. 1 is a schematic diagram, partially in cross section, showing a waste collection device according to the principles of the present invention connected to a garbage grinder below a kitchen sink;

FIG. 2 shows a cross section of a waste accumulation container of the present invention removed from a separator of the invention for emptying;

FIG. 3 is a top plan view of the waste accumulation container of FIG. 2;

FIG. 4 is an enlarged fragmentary view of a pressure release valve from the waste accumulation container of the present invention;

FIG. 5 is a cross section of the pressure release valve of FIG. 4; and

FIG. 6 is a cross section of a second embodiment of the pressure release valve of the present invention.

DESCRIPTION OF THE PREFERRED EMBODIMENTS

Referring first to FIG. 1, a sink 10, such as a kitchen sink, is shown having a garbage grinder 12, commonly referred to as a garbage disposal, connected at a drain 14. The garbage grinder 12 has an outlet 16 through which ground waste material and waste water flow to a waste collection device 18 of the present invention, comprising a waste separator 20 and a waste accumulation container 22. The present waste collection device 18, in turn, includes an outlet 24 connected to a sewage conduit 26, preferably including a plumbing trap 28.

More specifically, the outlet 16 of the garbage grinder 12 has connected to an elbow conduit 30 by a connector 32, the elbow conduit 30 in turn being connected to an inlet 34 of the separator 20. A threaded connector 36 fastens the elbow conduit 30 to the inlet 34. Likewise, a second elbow conduit 38 is connected at the separator outlet 24 by a threaded connector 40, the elbow conduit 38 in turn being connected to the trap 28.

Internally of the separator 20, an inlet passage 42, and an outlet passage 44 are defined by a separating wall, or partition, 46 disposed therebetween. In the illustrated embodiment, the inlet passage 42 is of gradually increasing cross-sectional area in the direction of flow, as shown by the arrows F, to cause the flow velocity to slow as it enters the separator 20. The cross-sectional area in the direction of flow of the outlet passage 44 is greater than the cross-sectional area of the inlet passage so that the flow velocity out of the separator 20 is less than the flow velocity in, thereby preventing solid material from being washed out of the separator 20.

The dividing partition 46 extends below the separator outlet 24, and preferably to the bottom of the separator 20, so that there is no flush-through between the separator inlet 34 and the separator outlet 24. Also, the partition 46 is angled to direct in-flowing material away from the outlet passage 44 to further aid in the separation process. A steady-state water level W is defined to form a trap within the separator 20, either by the level of the separator outlet 24, or by the plumbing trap 28. In this way, the back flow of air and gases from the sewage line 26 is prevented. Thus, a plumbing trap 28 may not be required in some applications. In other embodiments, the inlet passageway and outlet passageway of the separator need not be adjacent one another, but instead can be spaced from one another. Therefore, although the preferred embodiment of the separator is shown, various other shapes and arrangements are possible.

The waste accumulation container 22 is affixed at a lower outlet 47 of the separator 20 by a threaded connector 48, which is preferably a wing nut. A gasket 49 is provided to seal the connection between the separator 20 and the container 22. The waste accumulation container 22 defines a waste holding compartment 50 that is in communication with the separator 20 and into which waste water and solid waste material are received. A central opening 52 in a top surface 54 of the container 22 is connected by the threaded fastener 48 to the separator 20, and in the illustrated embodiment is spaced above the top surface 54 by an annular neck 56. Extending around the perimeter of the top surface 54 is a raised rim or lip 58 which forms a catch basin 60 on the top surface 54. A pressure release, or relief, valve 62 is included in the preferred embodiment of the container 22, such as in the top surface 54.

The present waste collection device is mounted below a sink 10, such as a kitchen sink, and preferably in a cabinet (not shown). It can be easily connected in an existing sewage system and, although the present device is shown in use downstream of a kitchen garbage grinder, it can be connected downstream of a sink without a garbage grinder or, indeed, any source of liquid and solid waste. Since the garbage grinder 12 and the sewage conduit 26 may not be able to support the weight of the water-filled waste container 22, some type of support means (not shown) may be required in some applications. For instance, a shelf may be provided on which the container 22 rests. Such shelf would aid in removal of the container as well.

In operation, waste water and household garbage material flowing from the garbage grinder 12 enter the separator 20, where the flow velocity is slowed by the increasing cross section of the passageway 42. The slower flow velocity in the inlet passage 42 and in the compartment 50 permits solid matter to settle into the waste compartment 50, while the excess waste water flows up the outlet passageway 44 and eventually into the sewage conduit 26. Since the cross-sectional area of the inlet conduit 42 is less than that of the outlet conduit 44, a relatively lower flow velocity from the separator 20 substantially reduces the likelihood that the solid material will be washed from the compartment 50, thereby further insuring that the solid matter remains therein.

Solid waste material, as indicated by the dotted line G accumulates in the waste compartment 50, and when full, or when the user desires to empty the compartment 50, the container 22 is easily removed from the separator 20 by operation of the wing nut 48. Once disengaged from the container 22, the wing nut 48 can be moved upward along the separator 20 to permit the container 22 to be removed sidewardly, such as if it were resting on a shelf. Upon separation of the container 22 from the separator 20, waste water remaining in the separator 20 will drain and be caught in the catch basin 60 formed on the top surface 54 of the container 22. Thus, the raised rim 58 must be high enough to provide a catch basin 60 of sufficient volume to at least retain the contents of the separator 20.

After removal of the container 22 from the separator 20, a second container is preferably available for connection on the separator 20. The filled container 22 is then emptied onto a compost heap.

In FIG. 2, the container 22 is shown removed from the separator 20 for emptying. After the cap 70 is placed over the opening 52, any liquid in the catch basin 60 can be drained therefrom. A cap 70 from which extends a carrying handle 72 is threadably received on the neck 56 to cover the central opening 52. With the carrying handle 72, the container 22 can be easily carried to a compost heap for emptying. Since the organic material contained within the container 22 may have begun decomposing, a vent opening 74 is provided in the cap 70 to permit the escape of gases. The cap 70 is provided with a gasket 75. The cap 70 permits the container 22 to be carried without spillage, or to be capped for later emptying. The interior surfaces of the container 22 are preferably smooth, preventing the accumulated garbage from remaining therein. Although the container may be formed of plastic or some other material, stainless steel is preferred. To aid in the removal of stubborn accumulations of material, means for flushing the container 22 may be provided, such as a threaded hose fitting (not shown) for accepting a garden hose.

The waste container 22 is shown in FIG. 3 having a generally rectangular shape with the opening 52 centrally disposed therein. Although a rectangular shaped container 22 is shown, it is contemplated to provide a variety of other shaped containers, depending on the application and the space available beneath the sink 10. The pressure release valve 62 can be seen on the top surface 54 of the container 22.

The pressure release valve 62, shown in FIG. 4, has an annular retaining ring 80 surrounding a circular rupture membrane 82. The retaining ring 80 holds the release valve 62 in the top surface 54 of the container 22, while the rupture membrane 82 provides a weakened region which will break, or rupture, upon the build-up of excessive gases within the container 22 from fermenting and decomposing organic material. For instance, blockage of the vent 74 or the drain 14 may result in pressure build-up. In the illustrated embodiment, portions 84 of reduced thickness are formed in the rupture membrane 82 along two diameters thereof, as well as between the circular membrane 82 and the annular flange 80.

The portions 84 of reduced thickness can be seen more clearly in FIG. 5. The annular retaining flange 80, in conjunction with a lower retaining flange 86, holds the release valve 62 in the top surface 54. Preferably, the lower flange 86 is of a greater diametric extent than the top pertaining flange 80 to resist outward pressure. Upon the build-up of excessive pressure within the container 22, the rupture membrane 82 breaks at the weakened portions 84 and, thereby, prevents a possibly dangerous explosion or leakage of the container 22. The pressure release valve of FIG. 5 is preferably formed of a plastic material set in the top surface 54 of the stainless steel container 22 and is replaceable upon rupture.

In FIG. 6, a second embodiment of a release valve 90 is shown formed directly in the top surface 54 of the container 22. The second embodiment includes portions 92 of reduced thickness similar in shape to the embodiment of FIGS. 4 and 5, although no retaining flanges are required since the valve 90 is integral with the container 22. Thus, a separate part is not required for the pressure release valve 90 of FIG. 6; however, once the valve 90 ruptures, the entire container 22 must be replaced. Other types of pressure responsive valves as are known in the art can be used in place of the release valves disclosed herein.

In other developments of the present invention, it is contemplated to provide a cap, such as a domed cap, for threaded connection to the lower outlet 47 of the separator 20 so that the present waste collection device 18 can be temporarily placed out of service by providing flush-through of both waste water and solid material. Another feature contemplated for the present invention is to provide a view window in the accumulation container 22 so that the state of the container 22 can be easily determined for emptying. The present device may be affixed in a sewage transmittal system either downstream or upstream of the trap 28, or without the trap 28 at all. When connected downstream, the trap 28 will prevent the transmittal of odors and gases from decomposing material within the accumulation container 22.

Additional features foreseen include the provision of carrying handles on the sides of the container 22, extending from the top edge of the rim 58, and/or a gripping indentation in the bottom adjacent an edge of the container 22 for tilting. The container 22 is preferably small enough to be easily carried when full, but large enough to require only infrequent emptying. Although the opening 52 in the container 22 is shown being centrally located in the top surface 54, it is also contemplated to provide the opening 52 to one side for easier emptying of the container 22.

Although other modifications and changes may be suggested by those skilled in the art, it is the intention of the inventor to embody within the patent warranted hereon all changes and modifications as reasonably and properly come within the scope of her contribution to the art.

I claim as my invention:

1. A container removably connected to an outlet pipe downstream of a garbage grinder to collect food waste entrained in a liquid stream, comprising:

a hollow container having an inlet opening above a top surface and an outlet;

means for removably connecting at least a portion of said hollow container in communication with the garbage grinder outlet pipe to accept the food waste entrained in the liquid stream;

a rim projecting upwardly from said top surface and extending around said removably connecting means to catch liquids escaping during removal of said hollow container from the grinder outlet pipe;

a trap formed in said hollow container between said inlet opening and said outlet;

a cap selectively fastenable to close said hollow container when said at least a portion of said hollow container is disconnected from the garbage grinder outlet pipe;

a pressure relief valve in said hollow container; and means for carrying said hollow container when said at least a portion of said hollow container is disconnected from the grinder outlet pipe.

2. A container as claimed in claim 1, wherein said hollow container is of stainless steel.

3. A container as claimed in claim 1, wherein said pressure relief valve includes a rupture membrane in said top surface of said hollow container.

4. A container as claimed in claim 1, further comprising: a separator in communication with said inlet opening to separate food waste from the liquid stream and forming said trap.

5. A container as claimed in claim 4, wherein said at least a portion of said hollow container is removably connected to said separator.

6. A container as claimed in claim 4, wherein said separator includes a partition wall between said inlet opening and said outlet and a passageway of increasing cross-sectional area in the direction of flow of the liquid stream to reduce the flow velocity of the stream, said passageway in communication with said hollow container.

7. A container as claimed in claim 1, wherein said removable connecting means includes a threaded wing nut and a threaded flange.

8. A container as claimed in claim 1, wherein a vent opening is formed in said cap.

9. A waste collection device connected between a garbage grinder and a sewage conduit to separate solid material from a waste flow, comprising:

a separator having an inlet passage of increasing cross section in the direction of flow connected to receive the waste flow from the garbage grinder, said separator having an outlet passage connected to an outlet opening, said outlet passage being of greater cross section than said inlet passage, said outlet opening being above a lower end of said inlet passage to form a trap;

a waste accumulation container having a top opening connected to said separator at said lower end of said inlet passage and defining a waste holding compartment for receiving the waste flow and collecting solid material, said waste holding compartment having a smooth interior surface;

means for disconnecting said waste accumulation container from said separator;

a catch basin formed in a top surface of said waste accumulation container to catch waste flow from said separator upon disconnection of said waste accumulation container from said separator, said catch basin being formed of a substantially vertical wall encircling said top opening of said waste accumulation chamber; and a pressure relief valve in said top surface of said waste accumulation container.

10. A waste collection device as claimed in claim 9, wherein said disconnecting means includes a threaded wing nut connecting a lower end of said separator to said top opening of said waste accumulation container.

11. A waste collection device as claimed in claim 9, further comprising:

a threaded cap for selectively fastening over said top opening of said waste accumulating container;

a carrying handle connected to said threaded cap; and a vent opening formed in said threaded cap.

12. A waste collection device as claimed in claim 9, wherein said pressure relief valve is a membrane having portions of reduced thickness.

13. A waste collection device as claimed in claim 12, wherein said membrane is integrally formed in a wall of said waste accumulation container.

* * * * *